US005587770A

United States Patent [19]

Jo et al.

[11] Patent Number: 5,587,770

[45] Date of Patent: Dec. 24, 1996

[54] DEVICE FOR DETECTING REMAINING LEVEL OF TONER

[75] Inventors: Hae-Seog Jo; Chang-Kyung Ko; Dong-Ho Lee, all of Suwon, Rep. of Korea

[73] Assignee: SamSung Electronics Co., Ltd., Suwon, Rep. of Korea

[21] Appl. No.: 389,942

[22] Filed: Feb. 17, 1995

[30] Foreign Application Priority Data

Feb. 28, 1994 [KR] Rep. of Korea ..... 3776/1994

[51] Int. Cl.[6] ..... G03G 15/08

[52] U.S. Cl. ..... 355/208; 355/245; 355/260

[58] Field of Search ..... 355/208, 203, 355/246, 260, 245; 118/689, 688, 694; 222/DIG. 1

[56] References Cited

U.S. PATENT DOCUMENTS

| | | | |
|---|---|---|---|
| 3,935,517 | 1/1976 | O'Brien | 317/262 A |
| 4,133,459 | 1/1979 | Forward | 222/314 |
| 4,313,343 | 2/1982 | Kobayashi . | |
| 4,592,642 | 6/1986 | Imaizumi et al. . | |
| 4,626,096 | 12/1986 | Ohtsuka et al. | 355/208 |
| 4,668,074 | 5/1987 | Hirozane . | |
| 4,727,453 | 2/1988 | Ewing | 361/225 |
| 4,777,512 | 10/1988 | Takahashi et al. | 355/208 |
| 4,963,927 | 10/1990 | Ishihara | 355/207 |
| 5,036,358 | 7/1991 | Yoshida . | |
| 5,095,331 | 3/1992 | Takano . | |
| 5,117,259 | 5/1992 | Etou et al. . | |
| 5,151,740 | 9/1992 | Fujimoto | 355/246 |
| 5,160,966 | 11/1992 | Shiina et al. . | |
| 5,198,860 | 3/1993 | Yamanaka et al. . | |
| 5,214,475 | 5/1993 | Ishii et al. . | |
| 5,216,462 | 6/1993 | Nakajima et al. . | |
| 5,237,372 | 8/1993 | Ishii et al. . | |
| 5,317,369 | 5/1994 | Nakanishi . | |
| 5,398,106 | 3/1995 | Eguchi | 355/260 |

*Primary Examiner*—Thu Anh Dang
*Attorney, Agent, or Firm*—Robert E. Bushnell, Esq.

[57] ABSTRACT

The present invention provides a developing device of an electrophotographic recording system for developing an electrostatic latent image formed on a photosensitive drum. The developing device includes a hopper which stores toner and a developing roller which develops the electrostatic latent image formed on the photosensitive drum using the toner stored in the hopper. On one side of the hopper at a predetermined height from its bottom, a light-emitting element for emitting light is positioned. A toner detecting device detects the existence or non-existence of toner by using a light-receiving element positioned on the interior of the hopper which outputs signals corresponding to the existence or non-existence of toner in the hopper in response to the amount of the light received from the light-emitting element. An agitator conveys the toner to the developing roller and simultaneously cleans a light-emitting side of the light-emitting element and a light-receiving side of the light-receiving element in synchronism with a conveyance period of the toner. A signal transmitting device transmits signals from the light-receiving element to a CPU which compares the number of signals with a predetermined value, thereby determining a level of the toner.

21 Claims, 8 Drawing Sheets

DEVICE FOR DETECTING REMAINING LEVEL OF TONER

CROSS-REFERENCE TO RELATED APPLICATIONS

This application makes reference to, incorporates the same herein, and claims all benefits accruing under 35 U.S.C. §119 arising from an application for DEVICE FOR DETECTING REMAINING LEVEL OF TONER earlier filed in the Korean Industrial Property Office on 28 Feb. 1994 and there duly assigned Serial No. 3776/1994.

BACKGROUND OF THE INVENTION

The present invention relates to a developing device employed in an electrophotographic recording system and more particularly to a device for detecting a remaining level of toner which develops an electrostatic latent image formed on a photosensitive drum into a visible image. By detecting the toner level, a user can then supply additional toner to the interior of the system at an optimal time.

It is commonly known that typical electrophotographic recording apparatuses such as copying machines, laser beam printers, etc. form an invisible electrostatic latent image on the surface of a photosensitive drum. Toner, which is made of a carbon powder component and supplied to the surface of the photosensitive drum to visualize the electrostatic latent image, can then be transferred and fixed onto a printable medium, such as paper, to form a hard copy of the electrostatic image. The electrophotographic recording apparatus typically includes a hopper which contains the toner, and a toner detecting device installed within the hopper for sensing a remaining amount of toner. It is well known to those skilled in the art that one of the representative methods for detecting the remaining amount of toner is a method using a toner sensor, for example, a piezoelectric sensor. We have found that equipment requiring a piezoelectric sensor tends to be uncompetitively expensive, however, due to the cost of the piezoelectric sensor.

SUMMARY OF THE INVENTION

It is an object of the present invention to provide an improved device for detecting a remaining level of toner in an electrophotographic recording system.

It is another object to provide a developing device which can be substituted into an existing electrophotographic recording system using a piezoelectric type of toner sensor, without having to modify the body of the system.

It is still another object to provide a developing device which can be produced at a reduced price by substituting a photosensor type of toner detecting sensor for a piezoelectric type of sensor.

It is yet another object to provide a toner detecting device which can accurately detect when a remaining level of toner is in a low state and when the level of toner is in an empty state.

To achieve these and other objects, a developing device of an electrophotographic recording system for developing an electrostatic latent image formed on a photosensitive drum comprises a hopper which stores toner. A developing roller develops the electrostatic latent image formed on the photosensitive drum using the toner stored in the hopper. On one side of the hopper at a predetermined height from its bottom, a light-emitting element for emitting light is positioned. A toner detecting device detects the existence or non-existence of toner by using a light-receiving element positioned on the interior of the hopper which outputs signals corresponding to the existence or non-existence of toner in the hopper in response to the amount of the light received from the light-emitting element. An agitator conveys the toner to the developing roller and simultaneously cleans a light-emitting side of the light-emitting element and a light-receiving side of the light-receiving element in synchronism with a conveyance period of the toner. A signal transmitting device transmits signals from the light-receiving element to a central processing unit which compares the number of signals with a predetermined value, thereby determining a level of the toner.

BRIEF DESCRIPTION OF THE DRAWINGS

A more complete appreciation of this invention, and many of attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
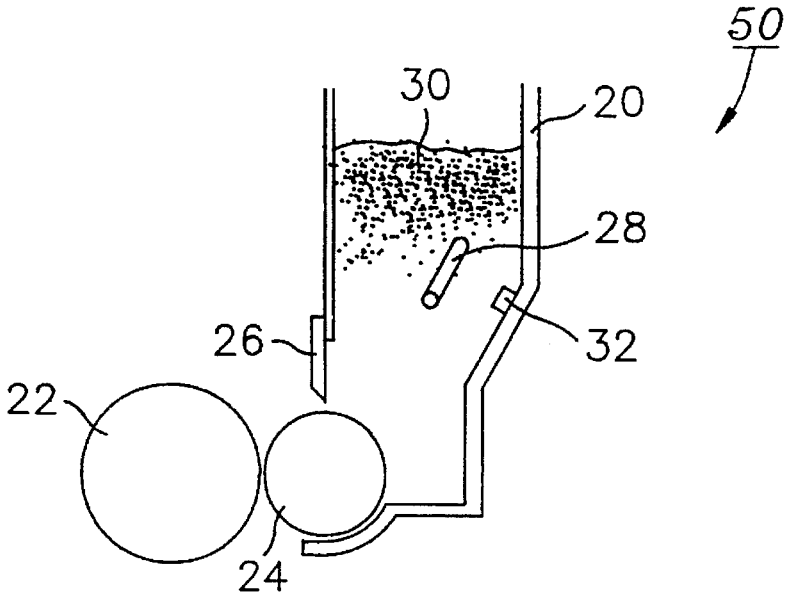
FIG. 1 is a sectional view illustrating a developing device provided with a conventional toner detecting sensor.
Figure 2:
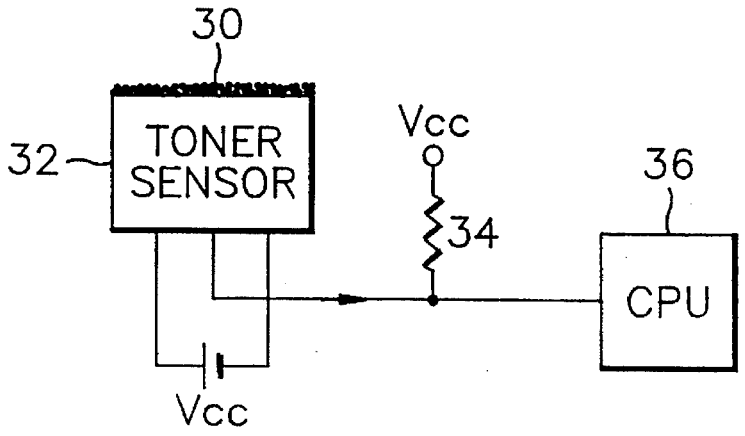
FIG. 2 is a diagram illustrating the construction of a conventional piezoelectric type of toner sensor, and its connection with a central processing unit (CPU)
Figure 3:
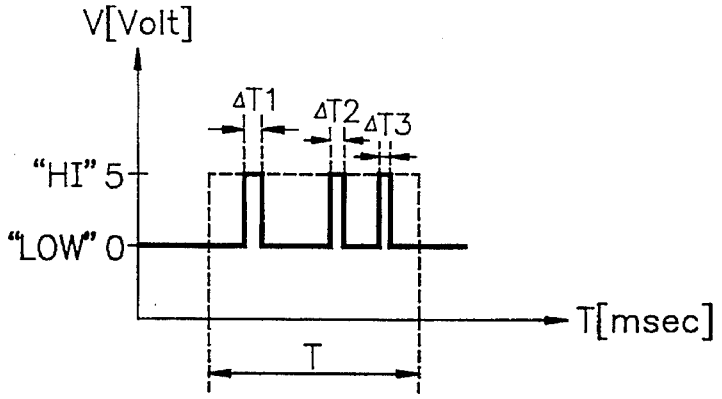
FIG. 3 is a waveform diagram illustrating the output state of a toner detecting signal from the conventional piezoelectric type of toner sensor.

Referring to FIGS. 1 through 3, a detailed description of a conventional device for detecting the existence and non-existence of toner will hereinafter be given.

FIG. 1 is a sectional view of a conventional developing device 50 containing a toner sensor 32. FIG. 2 shows electrical connections between toner sensor 32 of FIG. 1 and a CPU 36. FIG. 3 is a timing chart showing an output state of toner sensor 32.

In FIG. 1, a hopper 20 in developing device 50 represents a container for storing a carbon powder type of toner 30. Toner 30 is stored in an interior portion of hopper 20 for developing an electrostatic latent image formed on a photosensitive drum 22 into a visible image. Developing device 50 having hopper 20 is positioned in close proximity with the surface of photosensitive dram 22 where the electrostatic latent image is formed by a scanner or image-forming recording apparatus. Once formed, developing device 50 having a developing roller 24 develops the invisible electrostatic latent image formed on photosensitive drum 22 into a visible image.

Developing device 50 includes developing roller 24 which develops the electrostatic latent image into the visible image by supplying toner 30 in hopper 22 to the surface of photosensitive drum 22, a doctor blade 26 which is used to ensure that toner 30 applied to the surface of developing roller 24 is of a constant thickness, an agitator 28 which supplies toner 30 in hopper 22 to developing roller 24, and a toner sensor 32 positioned on the interior of hopper 22 which detects the existence or non-existence of toner 30. Examples of methods for developing the latent image electrically formed on photosensitive drum 22 into the visible image by developing device 50 include the "one component developing method", "two components developing method " and "magnetic brush developing method". These methods are well-known to those skilled in the art, and an explanation of them will be excluded in this detailed description for the sake of brevity.

In FIG. 1, toner sensor 32 for detecting the existence or non-existence of toner 30 in hopper 20 is a piezoelectric sensor. One principle of a piezoelectric sensor is that it alters its output voltage in response to detected applications of pressure on its upper portion. This detecting operation will now be described in more detail, with reference to FIG. 2.

When toner 30 stored in hopper 20 is supplied to developing roller 24 by rotation of an agitator 28 positioned in hopper 20, the surface of the upper portion of toner sensor 32 is cleaned. At this time, if hopper 20 contains a sufficient amount of toner 30, the toner 30 contacts toner sensor 32, and the pressure exerted upon the surface of toner sensor 32 can be detected.

If the amount of toner 30 is sufficient to apply a threshold amount of pressure upon toner sensor 32, the toner sensor 32 having a piezoelectric effect outputs a voltage of a logic "low" level. Alternatively, after toner 30 is removed from toner sensor 32 by rotation of agitator 28, if toner 30 does not contact the upper portion of toner sensor 32 due to a reduced amount of toner 30 or if the pressure exerted upon the toner sensor 32 is below a reference value, toner sensor 32 outputs a voltage of a logic "high" level to a central processing unit CPU 36 connected to an output terminal thereof. That is, in the situation where toner 30 contacts the upper portion of toner sensor 32, toner sensor 32 detects the existence of toner 30 and outputs a detecting signal of a logic "low" level indicating "toner existent". On the other hand, in the situation where toner 30 is deemed not to exist, toner sensor 32 detects this deficiency and outputs a detecting signal of a logic "high" level indicating "toner empty". During this time, a direct current voltage of 5 volts is supplied as operating power to toner sensor 32. Hence, in the case where toner 30 in hopper 20 is deemed not to exist, toner sensor 32 outputs a voltage of 5 volts indicative of the logic "high" level, whereas in the case that toner 30 is deemed to exist, toner sensor 32 outputs a voltage of 0 volts indicative of the logic "low" level.

The detecting signal output from toner sensor 32 indicative of the existence or nonexistence of toner 30 is supplied to an input terminal of CPU 36. CPU 36 detects the logic state of the detecting signal and then determines whether toner exists or does not exist. After recognizing the existence or non-existence of toner 30, CPU 36 displays the result of its determination on a display panel (not shown). Here, when the "toner empty" message is displayed, the operation of the system is stopped. A toner sensor 32 having the piezoelectric effect is commonly-used in a Model 5-u003 sensor produced by the Japanese company HITACHI company and in a Model TS05D sensor produced by the Japanese company TDK.

A conventional technique for detecting the existence or non-existence of toner by using a piezoelectric sensor and performing an operation similar to the aforementioned one is disclosed in more detail in U.S. Pat. No. 4,647,185 issued on Feb. 22, 1985 to Takeda et al. (hereinafter referred to as Takeda et al. '185).

In Takeda et al. '185, an output terminal of toner sensor 32 is connected to an input terminal of CPU 36. CPU 36 reads the output of toner sensor 32 according to a clock period of the system, thereby detecting the existence or non-existence of toner 30. Such a detecting operation varies in accordance with the design specifications of CPU 36 or the clock period of the system, however, it is typical that the detecting operation be performed according to a period of 10 milliseconds.

The rotation of agitator 28 in hopper 20 of developing device 50, as constructed in FIG. 1, usually does not exceed 60 rpm in conventional devices. That is, one to three seconds is generally a sufficient amount of time for rotation of agitator 28 to convey toner 30 in hopper 20 to developing roller 24.

Takeda et al. '185 provides disclosure of a technique where outputs of toner sensor 32 positioned on the interior of developing roller 50 are counted for a predetermined time period, and the counted value is compared with a predetermined value to determine the remaining level of toner. This operation of Takeda et al. '185 will hereinafter be described with reference to FIG. 3.

In the case where toner 30 does not exist and therefore does not contact the upper portion of toner sensor 32 of developing device 50, toner sensor 32 outputs the detecting signal of a logic "high" level. The detecting signal is then supplied to CPU 36, as mentioned above. CPU 36 scans its input terminal for a predetermined time period T, according to 10 millisecond periods. During this scanning period T, assuming that toner sensor 32 outputs three signals of a logic "high" level during periods $\Delta T_1$, $\Delta T_2$ and $\Delta T_3$, CPU 36 counts these three signals of the logic "high" level output from toner sensor 32. That is, $\Sigma\Delta T=\Delta T_1+\Delta T_2+\Delta T_3$. In the case that the value of a ratio of $\Sigma\Delta T$ to the predetermined time period T,I. e., of $$\frac{\Sigma\Delta T}{T}$$

is below a predetermined value, CPU 36 recognizes the toner level as normal, whereas in the case that the value of $$\frac{\Sigma\Delta T}{T}$$

is above the predetermined value, CPU 36 recognizes the toner level as abnormal. CPU 36 then displays a toner level message corresponding to a previously programmed state in accordance with the recognized level on the display panel to indicate the remaining level of toner 30.

For example, assuming that the predetermined time period T is 2.5 seconds and $\Sigma\Delta T$ (i.e. $\Delta T_1+\Delta T_2+\Delta T_3$) is 300 milliseconds, when $$\frac{\Sigma\Delta T}{T} \text{ is below } \frac{300\text{ msec}}{2500\text{ msec}}$$

(assuming that the output of toner sensor 32 is read according to a period of 10 milliseconds, the counted number is below 30), the amount of toner 30 is at a normal level, whereas when $$\frac{\Sigma\Delta T}{T} \text{ is above } \frac{300\text{ msec}}{2500\text{ msec}},$$

the amount of toner 30 is at an abnormal level.

The ratio of $$\frac{\Sigma\Delta T}{T}$$

has two threshold values of $$\frac{300\text{ msec}}{2500\text{ msec}} \text{ and } \frac{2400\text{ msec}}{2500\text{ msec}},$$

thereby classifying toner level into two distinct categories when the toner level is determined to be abnormal. That is, when $$\frac{\Sigma\Delta T}{T} < \frac{3}{25},$$

toner level is indicated as normal. Alternatively, when $$\frac{3}{25} < \frac{\Sigma\Delta T}{T} < \frac{24}{25}$$

a "toner low" or "developer low" state is indicated, and when $$\frac{\Sigma\Delta T}{T} > \frac{24}{25},$$

a "toner empty" or "developer empty" state is indicated (see Table <1>).

TABLE 1

| DISPLAY STATE | RATIO VALUES | NUMBER OF HIGH VOLTAGE OUTPUTS FROM SENSOR 32 |
|---|---|---|
| | $\frac{\Sigma\Delta T}{T} < \frac{3}{25}$ | A < 30 |
| "TONER LOW" | $\frac{3}{25} < \frac{\Sigma\Delta T}{T} < \frac{24}{25}$ | 30 < A < 240 |
| "TONER EMPTY" | $\frac{\Sigma\Delta T}{T} > \frac{24}{25}$ | A > 240 |

The display method indicated above is not disclosed in Takeda et al. '185, but it is regarded as a general method widely employed in electrophotographic recording systems.

The main problem associated with using a piezoelectric sensor in a toner detecting device is that the sensor is very expensive. Accordingly, utilizing such a sensor causes the cost of the system itself to be higher.

Various methods for sensing the existence or non-existence of toner without using the expensive piezoelectric type of toner sensor have been disclosed. One such method is disclosed in U.S. patent application Ser. No. 07/989,828, entitled "*Device For Detecting Toner Used In An Electrophotography Machine*" filed on Dec. 14, 1992 by Dong-Ho Lee (hereinafter referred to as the Lee application).

The Lee application includes a metal plate that rotates upwardly and downwardly in accordance with the amount of toner stored in the hopper, and a magnet that moves in response to the rotating distance of the metal plate in the exterior of the developing device. An actuator connected to the magnet cuts off or reflects light of a transmitting or reflecting photosensor centered around a hinge axis of the actuator, and generates a logic signal corresponding to the remaining level of toner. The Lee application has an advantage in that its device can be produced for a cost that is about one sixth lower than a device using the piezoelectric type of toner sensor.

The Lee application, however, fails to provide compatibility between its developing device and the one used in the electrophotographic recording system of Takeda et al. '185. That is, it is not possible to substitute the less expensive photosensor from the device disclosed in Lee's application for the more expensive piezoelectric type of sensor, such as the one disclosed in Takeda et al. '185.

Although there is no problem in producing instruments using the electrophotographic recording system disclosed in the Lee application, the lack of compatibility between the two types of systems does present a problem. In other words, a low-priced developing device, such as the one disclosed in the Lee application, cannot be used in an electrophotographic recording system using the more expensive developing device disclosed in Takeda et al. '185.

Accordingly, the electrophotographic recording systems disclosed in Takeda et al. '185 and the Lee application should each use only the type of developing device designed to meet their respective specifications. This requirement produces difficulties in using and managing the two types of systems since mutual compatibility between the two systems is deficient.

Figure 4:
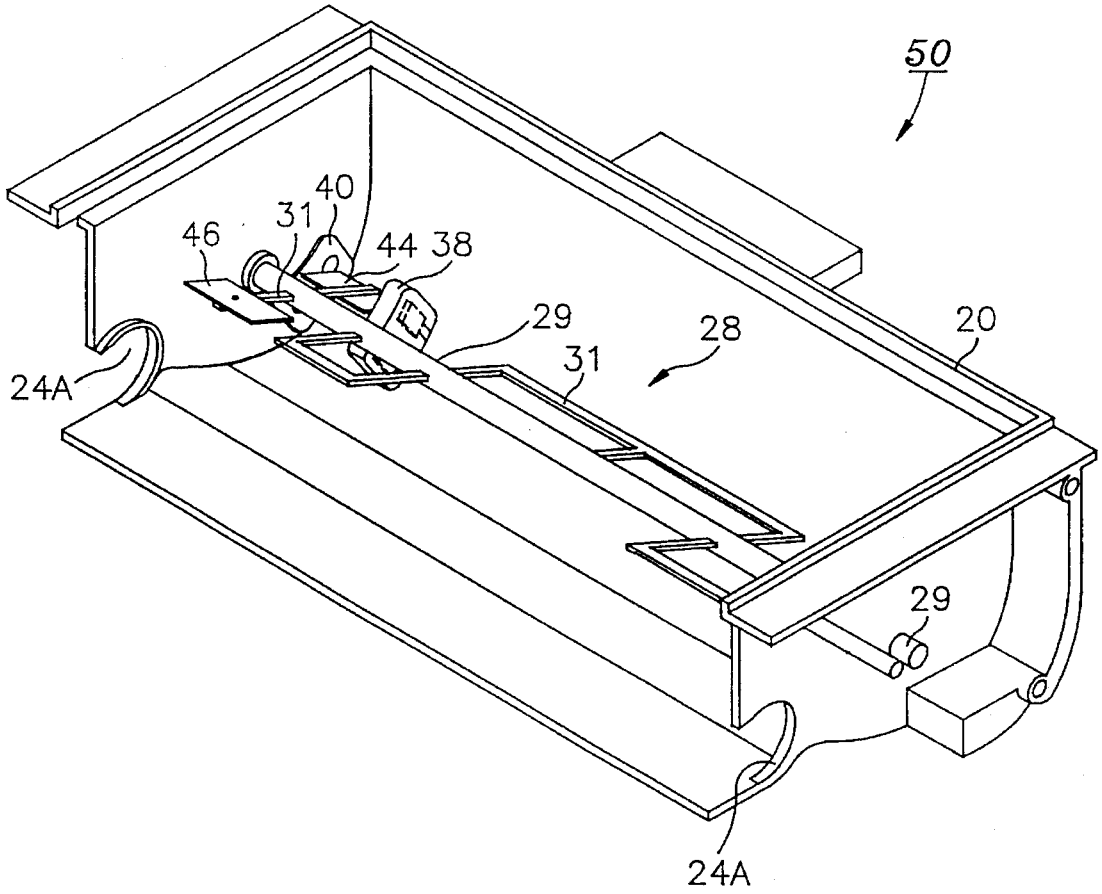
FIG. 4 is a perspective view illustrating a developing device provided with a toner detecting sensor constructed according to the principles of the present invention.
Figure 5:
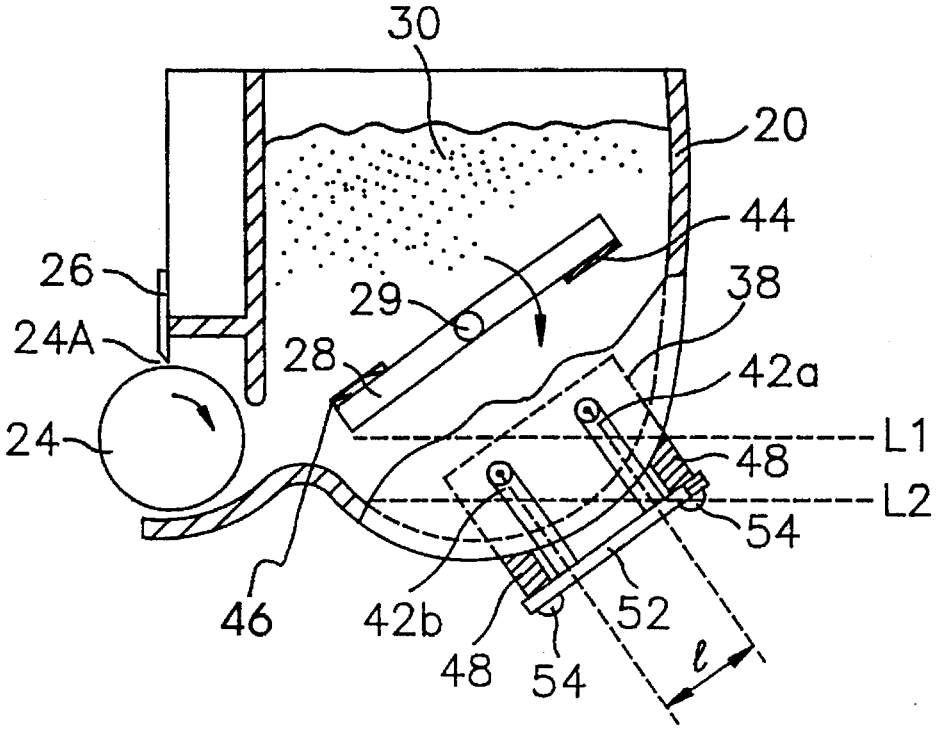
FIG. 5 is a sectional view illustrating a portion of the developing device of FIG. 4 for describing operations of the toner detecting device installed therein.
Figure 6:
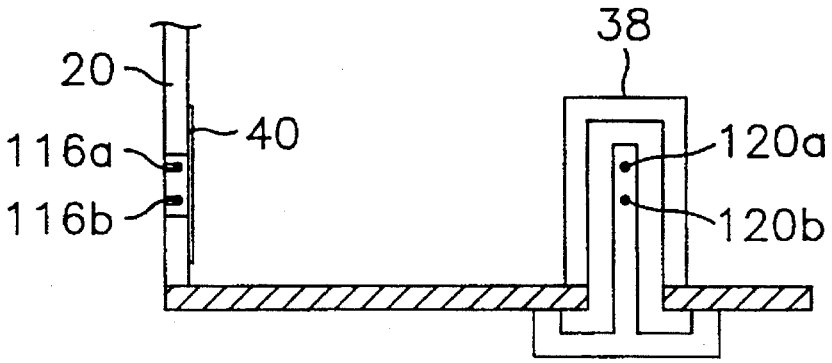
FIG. 6 is a longitudinal sectional view illustrating a portion of the developing device of FIG. 4 for describing a mounting position of the toner detecting device.

Referring now to FIGS. 4 through 6, FIG. 4 illustrates a perspective view of a developing device 50 provided with a toner detecting sensor constructed according to the principles of the present invention. FIG. 5 is a sectional view illustrating a portion of developing device 50 of FIG. 4 for describing operations of a toner detecting device installed therein. FIG. 6 is a longitudinal sectional view illustrating a housing of developing device 50, in which a photosensor is used as the toner detecting device. A detailed description of the construction of developing device 50 according to the principles of the present invention will now be given with reference to FIGS. 4 through 6.

Developing device 50 includes a hopper 20 for storing toner 30. At one side of hopper 20, there is provided a transmitting window 40 where a light source can be transmitted. A light-receiving window 38 for receiving the light source is positioned a predetermined distance from transmitting window 40. Light-receiving window 38 is composed of a transparent plastic material and projects upwardly.

Referring to FIG. 6, light-emitting elements 116*a* and 116*b*, which emit light corresponding to the input of an electrical signal, are internally installed on the interior of transmitting window 40. Light-receiving elements 120*a* and 120*b* such as two photodiodes, or two phototransistors, which receive the light source from light-emitting elements 116*a* and 116*b* and convert the amount of received light into an electrical signal, are internally installed in the interior of light-receiving window 38. Light-emitting elements, 116*a* and 116*b*, are fixably installed at a position parallel to light receiving elements 120*a* and 120*b*, respectively. In the present invention, a photosensor is made up of a pair of elements, that is, light-emitting element 116*a* positioned on the interior of transmitting window 40 and light-receiving element 120*a* positioned parallel with element 116*a*. Hence, it can be seen in the present invention that two photosensors are used.

Referring back to FIG. 4, a rotating shaft 29 of an agitator 28 is installed for supplying toner 30 to an opening 24*a* at both sides of hopper 20 in which transmitting window 40 and light-receiving window 38 are formed at the bottom portion thereof. Agitating wings 31 which have a square shape and are of a specified thickness are also provided. Agitating wings 31 are separated from each other at upper and bottom portions of rotating shaft 29 of agitator 28. Blades 44 and 46 composed of an elastic component, such as a plastic material, are attached to sides of agitating wings 31 of agitator 28 positioned between transmitting window 40 and light-receiving window 38. When agitator 28, constructed as described above, rotates with rotating shaft 29, toner 30 stored in hopper 20 is supplied to openings 24*a* where a developing roller 24 is positioned. While agitator 28 rotates, blades 44 and 46 simultaneously clean toner 30 remaining on the inner sides of transmitting window 40 and light-receiving window 38.

As described above, the present invention uses two photosensors which are positioned to be separated from each other so that one of the two photosensors is cut off by blades 44 and 46 attached to the sides of agitating wings 31 of agitator 28 and the other is opened. Referring to FIG. 5, relative positions of the two photosensors and blades 44 and 46 can be seen accurately. In FIG. 5, if a clockwise rotating direction of agitator 28 is set as a standard, it is assumed that a photosensor positioned in the upstream position is designated as reference numeral 42*a*, a photosensor positioned in the downstream position is designated as reference numeral 42*b*, and a distance 1 separating photosensors 42*a* and 42*b* is 10 millimeters. Under these assumptions, when blades 44 or 46 cut off photosensor 42*a*, photosensor 42*b* is opened, and when blades 44 or 46 continue to rotate and cuts off photosensor 42*b*, photosensor 42*a* is opened. Here, photosensor 42*a* is comprised of light-emitting element 116*a* and light-receiving element 120*a*, while photosensor 42*b* is comprised of light-emitting element 116*b* and light-receiving element 120*b*. Also, reference numerals 48, 52 and 54 designate mounts, PCB and screws, respectively.

An explanation of the operation for detecting a remaining level of toner 30 in developing device 50 where two pairs of photosensors are provided will now be given with reference to FIGS. 7A and 7B.

If agitator 28 centered around rotating shaft 29 rotates when the toner level in hopper 20 of developing device 50 is in a full state, agitating wings 31 rotate simultaneously. Then, toner 30 is supplied to developing roller 24 through openings 24*a*. At this time, if agitator 28 maintains rotation at a constant speed, cohesion of toner 30 stored in hopper 20 can be prevented. Furthermore, although blades 44 and 46 attached to the sides of agitating wings 31 of agitator 28 clean the walls of transmitting and light-receiving windows 40 and 38 by passing through the space between transmitting window 40 and light-receiving window 38 within hopper 20, toner 30 can be immediately supplied for a printing process.

Accordingly, light emitted from light-emitting elements 116*a* and 116*b* provided in the interior of transmitting window 40 is transmitted through transmitting window 40. Transmission of the light, however, is immediately cut off by toner 30 in hopper 20 since the toner level is in a full state. As shown in FIG. 5, if the remaining level of toner 30 within hopper 20 is higher than a first level L1, light-receiving elements 120*a* and 120*b* provided in the interior of light-emitting window 38 cannot receive the emitted light. Assuming that each of light-receiving elements 120*a* and 120*b* outputs a voltage of a logic "high" level when light is not received, and outputs a voltage of a logic "low" level when light is received, it can be appreciated that both light-receiving elements 120*a* and 120*b* output a voltage of a logic "high" level when the toner level is in a full state. Then, if the outputs from light-receiving elements 120*a* and 120*b* are logically added in a sensing signal transmitting circuit (see FIG. 9) and the result of the logical-addition process is inverted and supplied as an input to a CPU 110 which determines the existence or non-existence of toner 30 in a sequence as mentioned above, CPU 110 can determine that the input indicates that the toner level in hopper 20 is in a full state.

As toner 30 stored in hopper 20 is consumed and the remaining level of toner becomes lower, the possibility that light emitted from light-emitting elements 116*a* and 116*b* is transmitted to light-receiving elements 120*a* and 120*b* will increase as discussed below.

FIRST DETECTION LEVEL

Figure 7A:
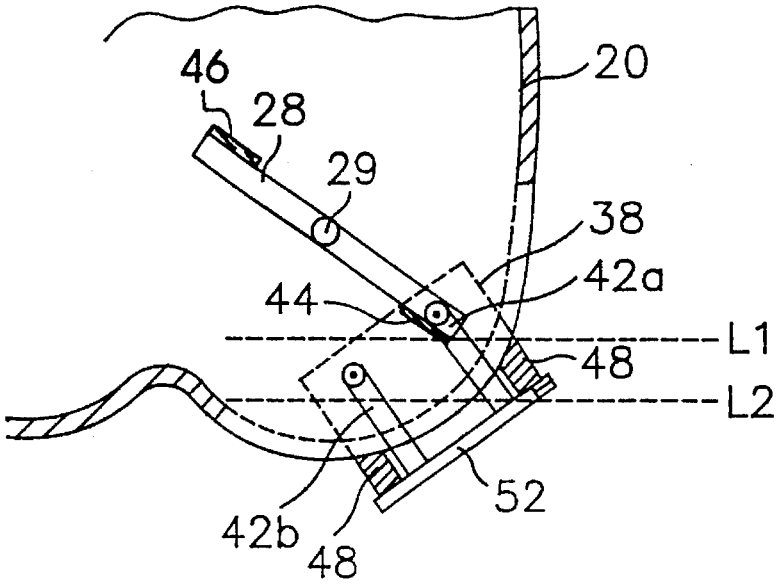
FIGS. 7A and 7B are views illustrating operations of the toner developing device, including an agitator having a blade, according to the principles of the present invention.
Figure 7B:
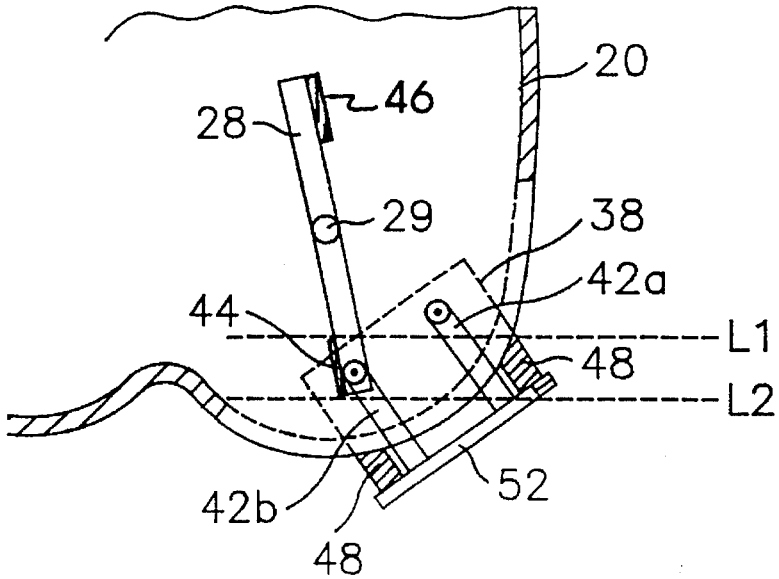

Under the condition that agitator 28 continues to rotate and the remaining level of toner 30 becomes lower than the first level L1, but higher than a second level L2 shown in FIGS. 7A and 7B, if blades 44 or 46 cut off the light of photosensor 42*b* of light-emitting window 40 as shown in FIG. 7B, the light path of photosensor 42*a* is open. Then, light-receiving element 120*a* in light-receiving window 38 receives the light transmitted from light-emitting element 116*a* of transmitting window 40 and outputs a logic signal corresponding to the amount of light received. Thereafter, if agitator 28 continues to rotate and blades 44 or 46 cut off the light path of photosensor 42*a* as shown in FIG. 7A, light-receiving elements 120*a* and 120*b* in light-receiving window 38 will output a toner detecting signal indicating that the toner level is in a normal state, since the light path of photosensor 42*b* is cut off by toner 30 having a remaining level in the interior of hopper 20 that is higher than the second level L2. Therefore, in the case that the remaining level of toner 30 is lower than the first level L1, but higher than the second level L2 shown in FIGS. 7A and 7B, after blades 44 or 46 clean transmitting window 40 and light-receiving window 38, it can be appreciated that only a signal sensed by photosensor 42*a* is transmitted to CPU 1 10. However, since the level of toner 30 can at least have an irregular level characteristic, the outputs of photosensors 42*a* and 42*b* are logically-added by the circuits discussed hereinafter, and then the logically-added output is transmitted to CPU 110. As previously discussed, the output of the toner sensor is read during the predetermined time period T according to a period of 10 milliseconds, a value ΣΔ T representative of the number of "high" pulses is generated and supplied to the input terminal of a CPU in which the remaining level of toner is determined. At this time, the CPU performs an algorithm for determining the remaining level of toner and analyzes the value ΣΔ T representative of the number of "high" pulses generated during the predetermined time period T, thereby determining the remaining level of toner stored in hopper 20. For example, a low level of the toner is determined by the value ΣΔ T indicating how many "high" pulses are sensed during the predetermined time period T.

SECOND DETECTION LEVEL

If, under the condition that the remaining level of toner 30 is lower than the second level L2 shown in FIGS. 7A and 7B, blades 44 or 46 cut off the light of photosensor 42*a* of light-emitting window 38 as shown in FIG. 7A, and the light path of photosensor 42*b* is open. Accordingly, light-receiving element 120*b* in light-receiving window 38 receives the light transmitted from light-emitting element 116*b* of transmitting window 40 and outputs a sensing logic signal corresponding to the amount of light received. Thereafter, if agitator 28 continues to rotate and blades 44 or 46 cut off the light path of photosensor 42*b*, as shown in FIG. 7A, light-receiving element 120*a* in light-receiving window 38 receives the light transmitted from light-emitting element 116*a* of transmitting window 40 and outputs a sensing logic signal corresponding to the amount of light received. Therefore, in the case that the remaining level of toner 30 is lower than the second level L2 shown in FIGS. 7A and 7B, after blades 44 or 46 clean transmitting window 40 and light-receiving window 38, it can be appreciated that the logic signals sensed by photosensors 42*a* and 42*b* are logically-added by the circuits as will be discussed hereinafter, and the logically-added output is then transmitted to CPU 110. As previously discussed, the output of the toner sensor is read out during the predetermined time period T according to a period of 10 milliseconds, the value ΣΔ T representative of the number of "high" pulses supplied to the input terminal of the CPU and the remaining level of toner is checked. At this time, the CPU analyzes the value ΣΔ T representing the number of "high" pulses generated during the predetermined time period T, thereby determining that the amount of toner 30 stored in hopper 20 is at an empty level.

Figure 8:
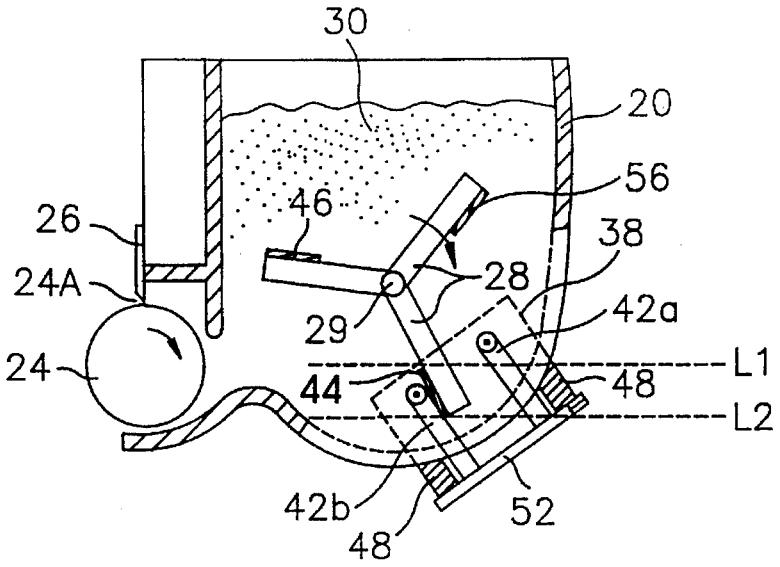
FIG. 8 is a view illustrating an embodiment of the present invention in which a plurality of blades attached to the agitator are provided.

FIG. 8 is a view illustrating another embodiment of the present invention in which three blades are attached to agitator 28 of FIG. 4. In this embodiment, a more stabilized sensing signal can be obtained when the mount of toner 30 in hopper 20 is at a low level. In constructing this embodiment, three agitating wings 31 are formed centering around shaft 29 of agitator 28, each of which is provided with a respective blade 44, 46 and 56. Operation of the embodiment shown in FIG. 8 will now be described.

As depicted in FIGS. 4 and 7, when only two blades 44 and 46 are attached to agitating wings 31 of agitator 28, if the remaining level of toner 30 is lower than the first level L1, but higher than the second level L2, problems caused by the following operational errors may arise.

As previously mentioned, when blades 44 and 46 clean transmitting window 40 and light-receiving window 38, the light path therebetween is opened. At this time, light-receiving element 120*a* in light-receiving window 38 receives the light transmitted from light-emitting element 116*a* in transmitting window 40 and outputs a toner sensing signal, for example, a toner sensing signal of a logic "high" level, corresponding to the amount of light received. Under the conditions mentioned above, if the position of blades 44 or 46 turns about 200° by rotation of agitator 28, toner 30 spread out on the plate of blades 44 and 46 is poured off, thus attaching to the surface of transmitting window 40 and light-receiving window 38. At this time, toner 30 composed of carbon power can cut off the light path between transmitting window 40 and light-receiving window 38. Therefore, light-receiving element 120*a* in the interior of light-receiving window 38 outputs a voltage of a logic "low" level. In this operation, even if the remaining level of toner 30 is substantially low, light-receiving element 120*a* of the photosensor may output a sensing signal indicating that the toner level is normal. That is, in the case where the amount of toner 30 remaining is low, an unstable signal giving a false indication about the toner level may be abruptly generated due to toner 30 pouring off blades 44 and 46 during rotation.

As shown in FIG. 8, however, if the number of agitating wings 31 of agitator 28 increases, and more than two blades are provided for cleaning transmitting window 40 and light-receiving window 38, such an operational error generated above can be prevented. In FIG. 8, blade 56 is additionally formed. In the situation where more than two blades are provided, instances of where blades remove toner 30 remaining in hopper 20 and the toner pours off the blades are substantially eliminated, thus preventing the abrupt generation of an inaccurate sensing signal.

Figure 9:
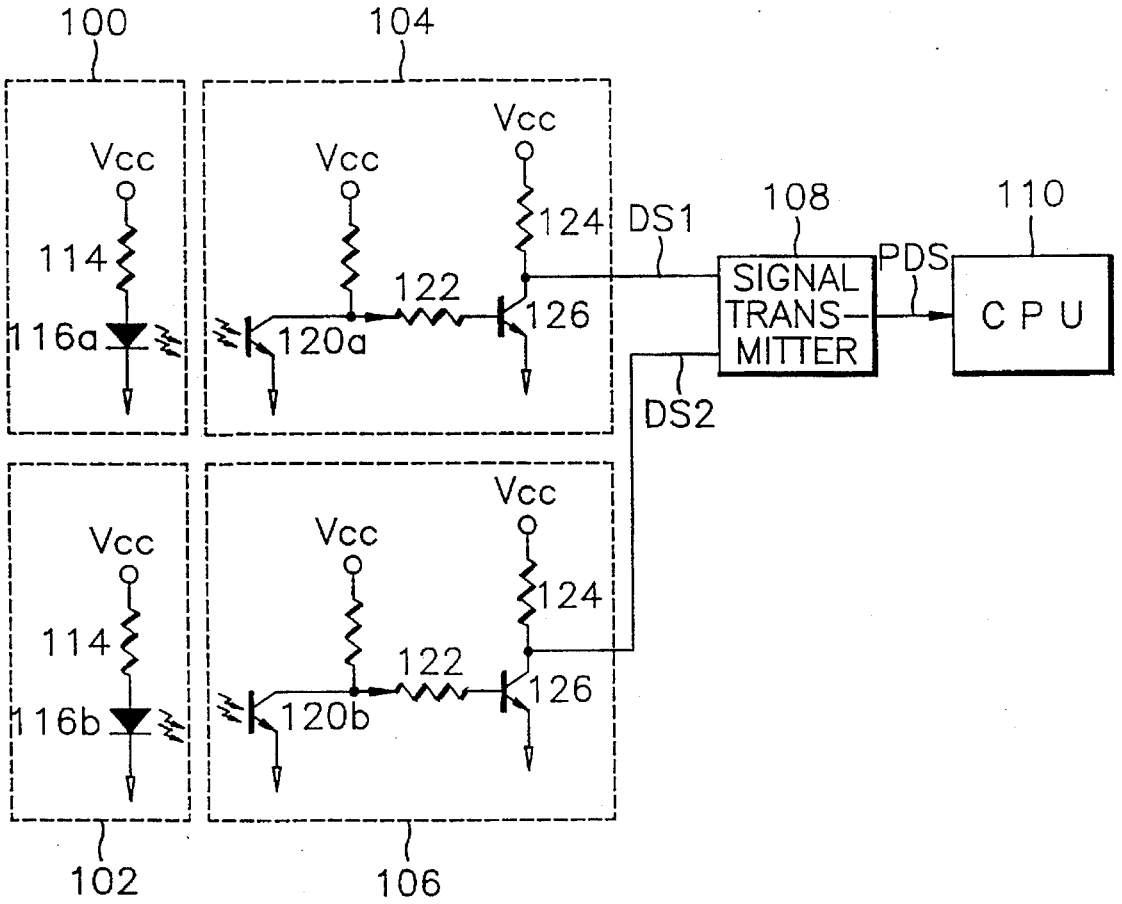
FIG. 9 is a circuit diagram illustrating a portion of an electrophotographic recording system which detects the existence and non-existence of toner by using the toner detecting sensor constructed according to the principles of the present invention.

FIG. 9 is a circuit diagram illustrating a portion of an electrophotographic recording system in which a sensing signal of photosensors 42*a* and 42*b* is optimally transmitted to CPU 110 in the developing device constructed as shown in FIG. 4. Reference numerals 100 and 102 designate first and second light-emitting devices having light-emitting elements 116*a* and 116*b* positioned on the interior of transmitting window 40. Reference numerals 104 and 106 designate first and second light-receiving devices having light-receiving elements 120*a* and 120*b* positioned on the interior of light-receiving window 38, which output sensing signals DS1 and DS2 corresponding to the amount of light received from light-emitting elements 116*a* and 116*b*. Reference numeral 114 designates biasing resistors. Light-emitting elements 116*a* and 116*b* are shown as light-emitting diodes and light-receiving elements 120*a* and 120*b* are shown as phototransistors. First and second light-receiving devices 104 and 106 include biasing resistors 118, and the portion comprised of resistors 122 and 124 and a transistor 126 serves as an inverter for inverting the output of phototransistors 120*a* and 120*b*. Furthermore, reference numeral 108 designates a signal transmitting device for logically-adding sensing signals DS1 and DS2 output from first and second light-receiving devices 104 and 106 to transmit the logically-added result to CPU 110. CPU 110 performs an algorithm for determining the remaining level of the toner and analyzes an input signal from signal transmitting device 108, thereby determining the remaining level of toner 30. Thereafter, CPU 110 displays the message corresponding to the determined level of toner remaining on a display device (not shown) to inform a user of the remaining level of toner 30.

A description of the operation of signal transmitting device 108 as shown in FIG. 9 will hereinafter be given.

When the power is turned on, light-emitting elements 116*a* and 116*b* always emit light in response to the power input via bias resistors 114. At this time, if the remaining level of toner 30 in hopper 20 is at the first detection level as described above, a first light path P1 between light-emitting element 116*a* and light-receiving element 120*a* is cut off by blades 44 or 46, and a second light path P2 between light-emitting clement 116*b* and light-receiving element 120*b* is cut off by toner 30. Hence, light-receiving elements 120*a* and 120*b* are open and transistors 126 connected thereto output toner sensing signals DS1 and DS2 at a logic "low" level to signal transmitting device 108.

When blades 44 or 46 move to the position shown in FIG. 7*b*, as first light path P1 between light-emitting element 116*a* and light-receiving element 120*a* is open, and light-receiving element 120*a* is accordingly switched on. Transistor 126 connected to light-receiving element 120*a* is then switched on to output toner sensing signal DS1 at a logic "high" level to signal transmitting device 108.

Signal transmitting device 108 implements logical-addition of sensing signals DS1 and DS2 by the operation mentioned above and then transmits the logically-added signal to CPU 110. Signal transmitting device 108 can be comprised of a single OR gate. At this time, CPU 110 counts the number of "high" pulses transmitted from signal transmitting device 108 during predetermined time period T according to a period of 10 milliseconds, compares the counted value with a predetermined value to determine an amount of toner currently remaining, and outputs a display message corresponding to the determined result.

If the remaining level of toner 30 in hopper 20 is at the second detection level as discussed earlier, each of the first and second light paths P1 and P2 is in turn cut off and opened in accordance with the movement of blades 44 and 46 during rotation of agitator 28. Accordingly, toner sensing signals DS1 and DS2 at a logic "high" level are alternately output from first and second light-receiving devices 104 and 106. Then, the sensing signals are logically-added and the logically-added signal is input to signal transmitting device 108. Hence, if the remaining level of toner 30 in hopper 20 is at the second detection level, a signal at a logic "high" level indicating a low or empty state of toner 30 is continuously input to CPU 110. At this time, CPU 110 reads the output of signal transmitting device 108 during predetermined time period T according to the period of 10 milliseconds, and compares the total number of signals at a logic "high" level read during predetermined time period T with a predetermined value, thereby displaying a "toner empty" message.

Figure 10A:
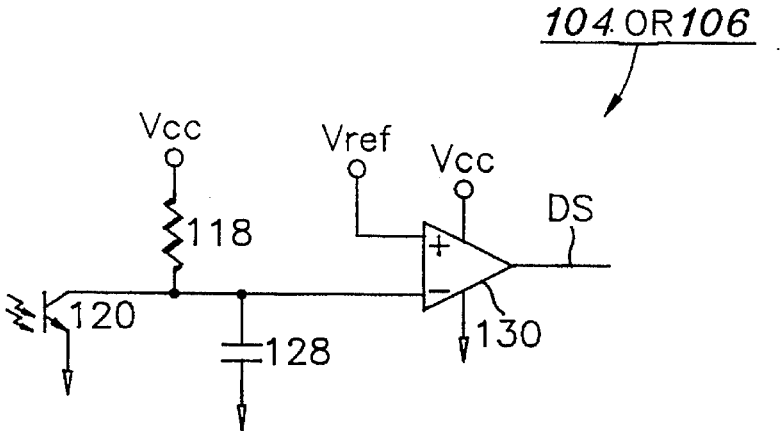
FIGS. 10A to 10C are circuit diagrams illustrating various embodiments of the light-receiving device of FIG. 9.
Figure 10B:
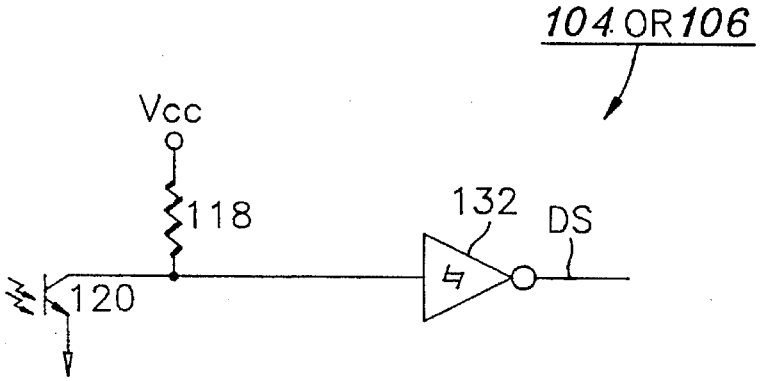
Figure 10C:
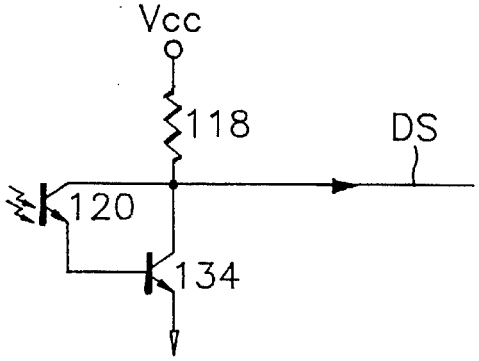

FIGS. 10A through 10C arc circuit diagrams illustrating various embodiments of first and second light-receiving devices 104 and 106 shown in FIG. 9. In FIGS. 10A and 10B, the inverter including switching transistor 126 of FIG. 9 is replaced with a Schmitt trigger inverter 132 (see FIG. 10B) or, alternatively, a comparator 130 (see FIG. 10A) wherein a reference voltage $V_{ref}$ and a waveform function are set. In FIG. 10A, reference numeral 128 designates a capacitor. With these constructions, a logic output corresponding to the output of light-receiving element 120 can be accurately generated. FIG. 10C shows another embodiment of the light-receiving devices in which a Darlington type of transistor 134 is used to compensate for low current driving performance of light-receiving element 120. Detailed operations of these other embodiments do not depart from the scope of the embodiment shown in FIG. 9.

Figure 11A:
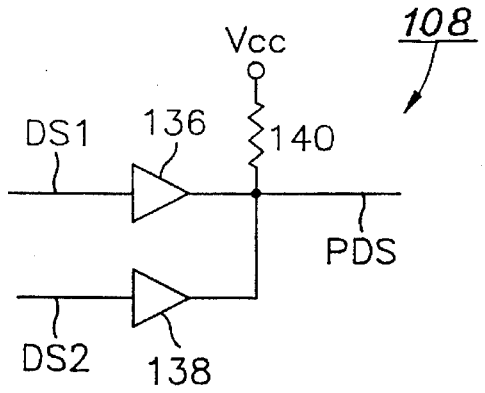
FIGS. 11A to 11C are circuit diagrams illustrating various embodiments of the signal transmitting device of FIG. 9.
Figure 11B:
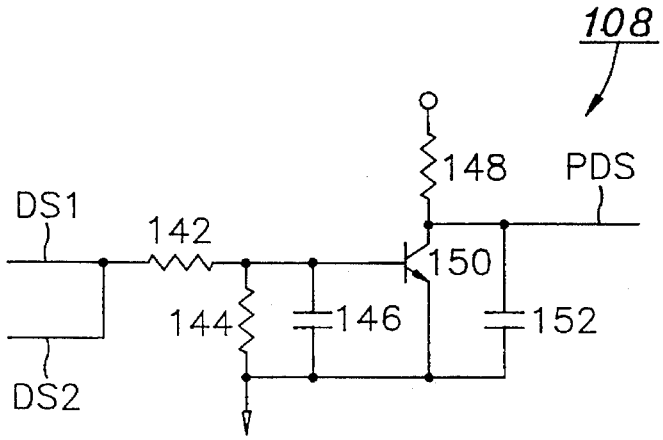
Figure 11C:
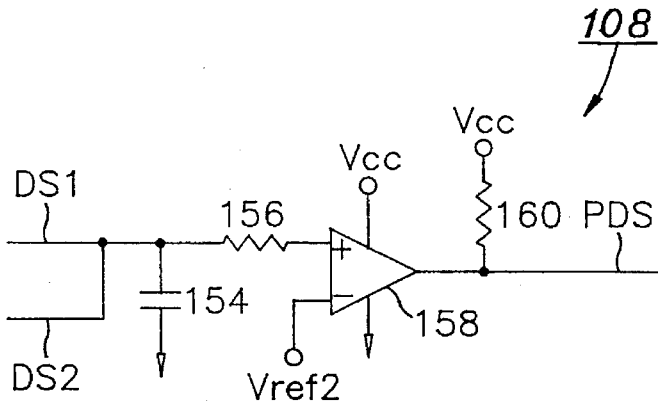

FIGS. 11A through 11C are circuit diagrams illustrating various embodiments of signal transmitting device 108 of FIG. 9. FIG. 11A is an embodiment in which open collector types of buffers 136 and 138 are constructed by a wired OR connection. Reference numeral 140 designates a resistor. In such a construction, an accurate logic signal corresponding to the level of sensing signals DS1 and DS2 output from first and second light-receiving devices 104 and 106 can be transmitted to CPU 110. The embodiment of FIG. 11B is useful in cases where each of the first and second light-receiving devices 104 and 106 generates toner sensing signals DS1 and DS2 by using bias resistor 118 between a power supply voltage $V_{cc}$ and ground potential and by using light-receiving element 120 of the phototransistor. FIG. 11B is another embodiment of signal transmitting device 108 in which toner sensing signals DS1 and DS2 output from the collector of a single phototransistor arc amplified by a conventional electric current amplifying circuit including a transistor 150, a plurality of resistors 142, 144 and 148, and capacitors 146 and 152 to supply the amplified signals to CPU 110. In FIG. 11C, sensing signals DS1 and DS2 output from first and second light-receiving devices 104 and 106 are supplied to a comparator 158 in which a reference voltage $V_{ref2}$ is set. Accordingly, the sensing signal at a logic "high" level indicative of the empty state of toner 30 is transmitted to CPU 110 only when the levels of toner sensing signals DS1 and DS2 exceed the level of reference voltage $V_{ref2}$, so that an accurate logic output corresponding to the output of light-receiving element 120 can be generated. In FIG. 11C, reference numerals 156 and 160 designate resistors and reference numeral 154 designates a capacitor.

After the two photosensors and signal transmitting device 108 performing a logical-addition process are constructed in developing device 50, which is then mounted onto the body of a conventional electrophotographic recording system using a piezoelectric type of toner sensor, a sampling is performed and the result is shown in the following Table <2>.

TABLE 2

| THE NUMBER OF DISPLAY ERRORS | THE NUMBER OF SAMPLING |
|---|---|
| 0 | 1 |
| 0 | 5 |
| 0 | 50 |

Figure 12:
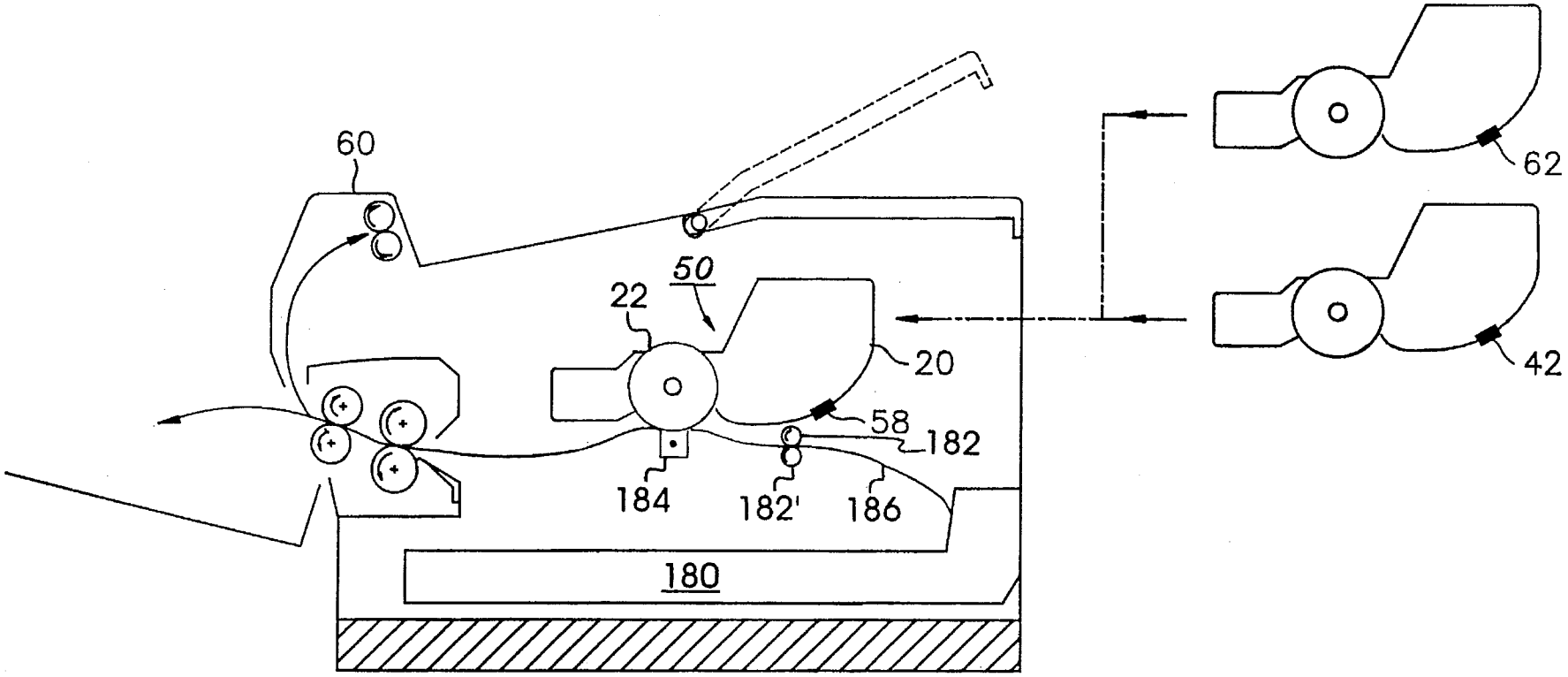
FIG. 12 is a general view of an electrophotographic recording system constructed according to the principles of the present invention illustrating compatibility between the body of the entire electrophotographic recording system and the developing device.

Referring now to FIG. 12, a general view of an electrophotographic recording system constructed according to the principles of the present invention is shown. The system includes developing device 50 installed within the interior of a body 60 that serves as a housing for the entire electrophotographic recording system. Body 60 accommodates a cassette 180 containing a plurality of transfer media such as blank sheets of cut paper, a pair of registration rollers 182, 182', and a transfer unit 184 for transferring a developer formed on photosensitive drum 22 to the transfer (or print) media. A path 186 of conveyance is provided within body 60, with individual sheets of the transfer media being sequentially conveyed along path 1.86, through registration rollers 182, 182' and between photosensitive drum 22 and transfer stage 184. Developing device 50 has hopper 20 for storing toner and a toner sensor 58 for detecting an amount of toner stored in hopper 20. With the present invention, developing device 50 can accommodate installation of either a piezoelectric sensor 62 or a photosensor 42 in hopper 20 as toner sensor 58, without any structural modification to body 60. Accordingly, the present invention advantageously provides mutual compatibility between developing device 50 and body 60, regardless of whether a piezoelectric sensor 62 or a photosensor 42 is installed in hopper 20 of developing device 50. Therefore, the present invention allows a user to replace a piezoelectric sensor with a less expensive photosensor, without modifying body 60.

As stated above, there is provided a developing device constructed according to the principles of the present invention that can be easily incorporated into a conventional electrophotographic recording system using a piezoelectric type of sensor, without any type of body modifications. The developing device of the present invention can utilize less expensive toner sensing means and therefore provides a developing device that can be produced at a lower cost than conventional devices.

What is claimed is:

1. A developing device of an electrophotographic recording system developing an electrostatic latent image formed on a photosensitive drum into a visible image, said device comprising:

toner storing means for storing toner;

developing means for developing said electrostatic latent image formed on said photosensitive drum by said toner stored in said toner storing means;

a toner detecting device for detecting one of an existence and non-existence of said toner, said toner detecting device comprising:

first and second light-emitting means for emitting light from a first side of said toner storing means at first and second predetermined heights from a bottom portion of said toner storing means, respectively; and first and second light-receiving elements positioned on an interior of said toner storing means for respectively outputting first and second corresponding signals indicative of a remaining amount of said toner in response to an amount of light received from said first and second light-emitting means, respectively;

an agitator for conveying said toner stored in said toner storing means to said developing means while simultaneously cleaning a light-emitting side of said first and second light-emitting means and a light-receiving side of said first and second light-receiving elements in correspondence with a rotational period of said agitator; and determining means for comparing a value obtained during a given time period by counting signals resulting from logically-adding said first and second corresponding signals with a predetermined value to determine a remaining level of said toner.

2. The developing device as claimed in claim 1, wherein said agitator comprises:

conveyance means formed on rotating means and inserted between said first side and a second side opposite said first side of said toner storing means for conveying said toner to said developing means; and cleaning means attached to said conveyance means for cleaning said light-emitting side and said light-receiving side in accordance with said rotational period of said agitator.

3. The developing device as claimed in claim 1, wherein said first and second light-emitting means are positioned on an interior of a transmitting window formed at said first side of said toner storing means, and said first and second light-receiving elements are positioned on an interior of a light-receiving window that projects upwardly in said interior of said toner storing means.

4. The developing device as claimed in claim 1, wherein said agitator comprises:

a plurality of agitating wings formed separately from each other on rotating means and positioned between said first side and a second side opposite said first side of said toner storing means for conveying said toner to said developing means; and blade means attached to said agitating wings for cleaning said light-emitting side and said light-receiving side in accordance with said rotational period of said agitator.

5. A developing device of an electrophotographic recording system for developing an electrostatic latent image formed on a photosensitive drum into a visible image, said device comprising:

toner storing means for storing toner, said toner storing means comprising a transmitting window for transmitting a light source generated from an exterior of said system, said light source being transmitted to an interior of said toner storage means at a first vertical level and a second vertical level lower than said first vertical level;

developing means for developing said electrostatic latent image formed on said photosensitive drum by said toner stored in said toner storing means;

an agitator for conveying said toner stored in said toner storing means to said developing means;

a light-receiving window projected upwardly in said toner storing means for receiving said light source transmitted through said transmitting widow;

blade means attached to said agitator for clearing a light path between said transmitting window and said light-receiving window in accordance with a rotational period of said agitator;

a toner detecting device positioned on an interior of said light-receiving window for detecting a remaining level of said toner by responding to an amount of said light source received via said cleared light path at heights corresponding to said first and second vertical levels, said toner detecting device logically-adding signals corresponding to said remaining level of said toner and outputting logically-added signals; and determining means for comparing a value obtained during a given time period by counting said logically-added signals output from said toner detecting device with a predetermined value to determine said remaining level of said toner.

6. An electrophotographic recording system that records by an image-forming device which enables an electrostatic latent image formed on a photosensitive drum to be a visible image, said system comprising:

a compatible developing device having containing means for storing toner and adopting a piezoelectric type of sensor or a photosensor type of sensor installed in the containing means to generate a signal corresponding to an mount of said toner stored in the containing means; and a body having determining means for determining a remaining level of said toner on the basis of the signal generated from said piezoelectric type of sensor or said photosensor type of sensor installed in said developing device, wherein said compatible developing device can use said piezoelectric type of sensor or said photosensor type of sensor in said system, without having to modify the body.

7. The electrophotographic recording system as claimed in claim 6, wherein said developing device uses said piezoelectric type of sensor in an initial production period of said system, but can be substituted to said photosensor type of sensor for the reduction of a production cost of said system.

8. The electrophotographic recording system as claimed in claim 6, wherein said developing device using said photosensor type of sensor comprises two photosensors, and logically adds signals generated from said two photosensors corresponding to the remaining level of said toner stored in the containing means to generate and output a logical result.

9. The electrophotographic recording system as claimed in claim 7, wherein said developing device using said photosensor type of sensor comprises two photosensors, and logically adds signals generated from said two photosensors corresponding to the remaining level of said toner stored in the containing means to generate and output a logical result.

10. An electrophotographic recording system having an image-forming device for enabling an electrostatic latent image formed on a photosensitive drum to be transferred as a visible image onto a recordable medium, said system comprising:

a developing device comprising containing means for storing toner;

sensing means installed within said containing means, for generating a signal corresponding to a quantity of toner stored within said containing means;

a body for accommodating installation of said developing device, said body comprising means for determining said quantity of said toner stored in said containing means in dependence upon said signal generated from said sensing means; and said developing device accommodating, without modification to said body, interchangeable installation of said sensing means with said sensing means comprising means for generating said signal selected from a group comprising materials exhibiting a piezoelectric response to contact with said toner and materials exhibiting a photosensitive response to light within said containing means during depiction of said toner.

11. The electrophotographic recording system of claim 10, wherein said means comprising said materials exhibiting said piezoelectric response arc replaced by said means comprising said materials exhibiting said photosensitive response without structurally modifying said body.

12. The electrophotographic recording system of claim 10, wherein said means comprising materials exhibiting said photosensitive response comprise first and second photosensors for respectively generating first and second sensing signals, said first and second sensing signals being logically added to output a result indicative of said quantity, of said toner stored in said containing means.

13. The electrophotographic recording system of claim 11, wherein said means comprising materials exhibiting said photosensitive response comprise first and second photosensors for respectively generating first and second sensing signals, said first and second sensing signals being logically added to output a result indicative of said quantity of said toner stored in said containing means.

14. The electrophotographic recording system as claimed in claim 8, further comprised of said two photosensors for generating said signals in response to light received at two different distances from a bottom portion of said containing means, respectively.

15. The electrophotographic recording system as claimed in claim 9, further comprised of said two photosensors for generating said signals in response to light received at two different distances from a bottom portion of said containing means, respectively.

16. The electrophotographic recording system of claim 12, further comprised of said first and second photosensors generating said first and second sensing signals in response to light received at first and second distances from a bottom portion of said containing means, respectively.

17. The electrophotographic recording system of claim 13, further comprised of said first and second photosensors generating said first and second sensing signals in response to light received at first and second distances from a bottom portion of said containing means, respectively.

18. A developing device of an electrophotographic recording system for developing an electrostatic latent image formed on a photosensitive drum into a visible image, said device comprising:

toner storing means for storing toner, said toner storing means comprising a transmitting window for transmitting light generated from an exterior of said system, said light being transmitted across an interior of said toner storage means to a first position and to a second position distinct and spaced-apart from said first position;

developing means for developing said electrostatic latent image formed on said photosensitive drum with the toner stored in said toner storing means;

an agitator for conveying the toner stored in said toner storing means to said developing means;

a light-receiving window projected upwardly in said toner storing means for receiving said light transmitted through said transmitting widow;

blade means attached to said agitator for cyclically clearing light paths through any of the toner within said toner storing means between said transmitting window and said light-receiving window in accordance with a rotational period of said agitator, with a first one of said paths extending between said first position and said light receiving window and being located upstream in said rotational period from a second one of said paths extending between said second position and said light receiving window, said second one of said paths being located downstream in said rotational order from said first one of said paths;

a toner detecting device positioned adjacent to an interior of said light-receiving window for detecting a remaining quantity of said toner by responding to an amount of said light received via cleared said light paths provided by said blade means corresponding to said first and second ones of said paths, said toner detecting device logically-adding signals corresponding to said remaining quantity of said toner and outputting logically-added signals; and determining means for comparing a value obtained during a given time period by counting said logically-added signals output from said toner detecting device with a predetermined value to determine said remaining quantity of said toner.

19. The developing device of claim 18, comprised of:

said toner storing means having a bottom;

said first position being located at a first height from said bottom; and said second position being located at a second and different height from said bottom.

20. The developing device of claim 18, comprised of:

said first one of said paths defining a first vertical level; and said second one of said paths defining a second vertical level lower than said first vertical level.

21. The developing device of claim 20, comprised of:

said cleared light paths corresponding to said first and second vertical levels; and said toner detecting device being positioned to detect a remaining level of said toner by responding to said light received via said cleared paths.

* * * * *